United States Patent [19]

Nicholson et al.

[11] Patent Number: 4,858,342

[45] Date of Patent: Aug. 22, 1989

[54] THERMOPLASTIC-RUBBER WADER AND METHOD OF MANUFACTURE

[75] Inventors: Joh E. Nicholson, La Crescent, Minn.; Tarachand S. Barma, La Crosse, Wis.

[73] Assignee: La Crosse Footwear, Inc., La Crosse, Wis.

[21] Appl. No.: 199,470

[22] Filed: May 27, 1988

[51] Int. Cl.[4] ..... A43B 23/06; A43B 1/10

[52] U.S. Cl. ..... 36/109; 36/2 R; 36/DIG. 2; 12/142 R

[58] Field of Search ..... 36/DIG. 1, DIG. 2, 1.5, 36/2, 4, 84, 87, 109; 12/1 F, 142 R

[56] References Cited

U.S. PATENT DOCUMENTS

| | | | |
|---|---|---|---|
| 2,197,357 | 4/1940 | Widmer et al. | 36/DIG. 2 |
| 2,367,629 | 1/1945 | Tappema et al. | 36/DIG. 2 |
| 2,371,868 | 3/1945 | Berg | 36/DIG. 2 |
| 2,651,062 | 9/1953 | Smiley | 12/1 F |
| 2,728,999 | 1/1956 | Hollier | 36/4 |
| 3,991,492 | 11/1976 | Dreyer | 36/109 |
| 4,244,121 | 1/1981 | Adams | 36/2 R |
| 4,542,597 | 9/1985 | Baptista et al. | 36/1.5 X |

*Primary Examiner*—Donald Watkins

*Attorney, Agent, or Firm*—Foley & Lardner

[57] ABSTRACT

A method for making a thermoplastic-rubber wader having a rubber footwear bottom and a thermoplastic upper, the method including the steps of treating an upper circumferential portion of the bottom, applying thermoplastic adhesive to the treated portion, applying a thermoplastic strip to the adhesive coating, applying a thermoplastic band to the upper to provide an interfacing annular seating surface with the thermoplastic strip, heat sealing the strip and band to provide a fluid tight unitary bond between the bottom and the upper and the wader formed by the above method.

12 Claims, 2 Drawing Sheets

FIG. 2
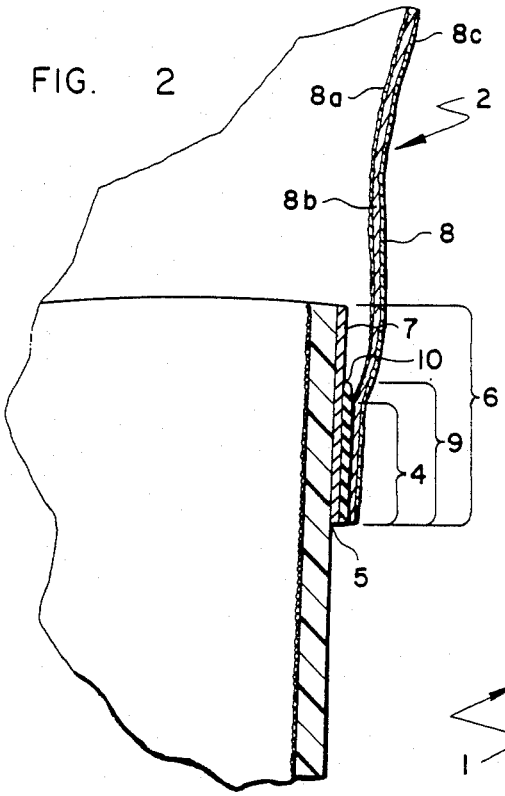
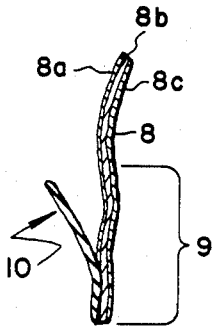
FIG. 4
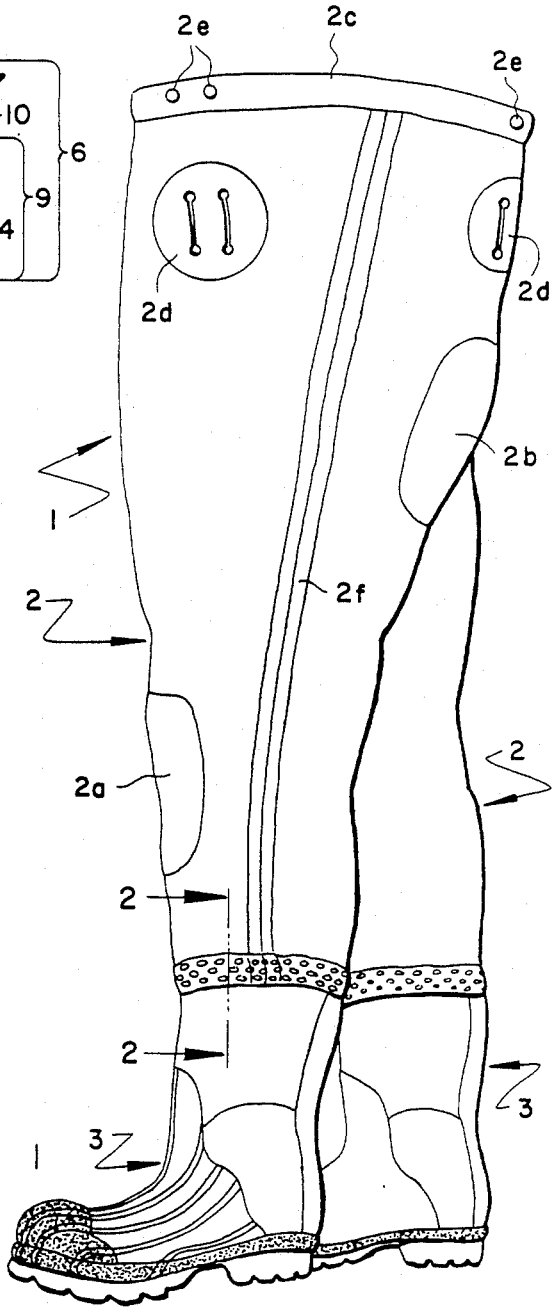
FIG. 1

THERMOPLASTIC-RUBBER WADER AND METHOD OF MANUFACTURE

BACKGROUND OF THE INVENTION

Sportsmen such as fishermen, migrant waterfowl hunters, etc. customarily use rubber waders to obtain access to stream beds too deep for conventional rubber overshoe products. These rubber waders are commercially available in a variety of forms such as hip or waist waders. Hip waders typically comprise two separate rubber vulcanizate boots, each fitted with an upper extending to the wearer's hip. Waist waders are typically of unitary construction similar in design to ordinary trousers. Other wader versions extend upwardly from the waist to cover the chest or shoulder regions of the wearer.

Waders of a rubber vulcanizate construction are particularly well suited for this purpose. The rubber construction provides a protective outerwear substantially impervious to water penetration. The rubber vulcanizate has sufficient elasticity to facilitate its outfitting by the wearer. In addition, the rubber sole portion affords adequate traction for use in most stream beds. A relatively thick gauge rubber construction is often required for protection against cutting, tearing, puncturing or flooding of the internal cavity.

Unfortunately, rubber waders are inherently heavy and cumbersome. The thicker gauge wader construction tends to reduce pliability and increase its bouyancy. The wader design and construction places constraints upon maneuverability, the ability to maintain balance within streams, and strains the physical endurance of the wader. Rubber waders are also subject to ozone deterioration. Such ozone exposure weakens the vulcanizate structure and particularly within the upper portions of the wader. These undesirable properties generally cause an ozone aged rubber wader to become less pliable and cracking or rupturing of its protective upper vulcanizate structure.

Within recent years, the art has attempted to overcome certain of these inherent deficiencies by the manufacture of wader products fabricated almost entirely from thermoplastic materials. The thermoplastic materials used in the upper wader construction generally comprises a thermoplastic composite material which includes one or more fibrous thermoplastic substrates in a woven mesh form, e.g. nylon, bonded together within a matrix of another thermoplastic substance such as polyvinylchloride (PVC). The upper wader portion may be appropriately cut from such calendered or laminated thermoplastic stock composite materials allowing for sufficient seaming margins to permit its overlapping and heat sealing together into the desired upper configuration. The thermoplastic bottom portions may be manufactured by conventional methods such as slush or injection molding techniques. The prefabricated thermoplastic uppers are typically heat sealed onto the thermoplastic bottom.

The major advantage of the thermoplastic wader products resides in its lightweight construction and ozone resistance attributes. Unfortunately, many of the other desirable attributes inherent to conventional rubber vulcanizate wader products, e.g. such as durability upon aging and use, resistance against cutting or puncture, elasticity, insulative value, comfort, permanency of the sealed regions against attrition or flooding, stream bed treading, etc., are sacrificed.

A long-felt need has existed for a lightweight wader product fitted with a rubber bottom and a lightweight thermoplastic upper securely and permanently bonded thereto. However, it is of paramount importance that such a proposed wader product afford protection against water penetration and flooding. A possible approach for securing vinyl uppers to rubber bottoms would involve simply sewing the vinyl uppers onto the rubber bottoms and sealing the stitchings with a waterproof sealant. Such an approach is not, of itself, a satisfactory solution to the problem. Perforations caused by stitching must not only be completely sealed but also must be able to permanently retain its sealant integrity. Stitching inherently fails to consistently produce a uniform bond between the stitched components and this factor becomes even more pronounced upon usage of the wader. Consequently the stitched and sealed area tends to fatigue and deteriorate with wear, which in turn, leads to leakage and flooding. Such matters are further compounded by acute manufacturing and quality control problems which make it especially difficult to consistently produce a water-tight wader on a mass production basis.

Several inherent bonding difficulties arise when one attempts to simply adhesively bond a wader vinyl upper directly onto a vulcanizate bottom. Direct adhesive bonding of a wader vinyl upper onto the rubber vulcanizate bottom is not feasible. Adhesive compositions compatible with rubber vulcanizates are generally incompatible with a thermoplastic upper. Although a rubber vulcanizate may be chemically treated to render it compatible to a thermoplastic adhesive composition, the normal use of the wader would place considerable strain and fatigue upon any such adhesive bond therebetween. Migration of chemicals deleterious to adhesive bonding reagents, e.g. plasticizers, from either the vulcanizate or thermoplastic upper may also destroy the efficacy of the adhesive bond. Elasticity differences also exist between the rubber vulcanizate and a thermoplastic upper. A wader is also subjected to repetitive stretching, relaxation and restretching of its structural components during its normal usage. The most vulnerable and critical point for preserving the desired water-tightness in such a proposed wader product exists within the joining bond between the vinyl upper and the vulcanizate. The bonding area must necessarily possess sufficient strength and durability to permanently maintain its structural integrity and water-tightness.

SUMMARY OF THE INVENTION

It would be highly advantageous to be able to provide a wader combination fitted with a lower rubber vulcanizate portion, e.g. calf and foot portion, and an upper portion of a lightweight thermoplastic construction. Such a combination would significantly reduce the bulkiness and weight of the wader product while also preserving the excellent water, cut and puncture resistant attributes of a rubber vulcanizate bottom. The rubber bottom structure would retain the desired elasticity for ease of fitting and removal. The rubber bottom and low cost thermoplastic upper combination would contribute towards a lower center of gravity. The more flexible and snuggly fitting thermoplastic upper construction would also tend to reduce bouyancy. Collectively such advantages would also contribute to more effectively maintaining the wader's underfooting and balance within a stream bed while also enhancing maneuverability and reducing physical fatigue of the wearer. A thermoplastic upper would also alleviate the problem of the rubber uppers susceptibility to ozone deterioration.

The present invention relates to a wader footwear product equipped with a rubber bottom to which there is firmly bonded a thermoplastic upper in a fluid-tight relationship. The bond has sufficient bonding strength and durability to maintain its structural integrity and represents a significant technological advance within the wader footwear art.

A primary feature of the invention is a method for effectively and consistently manufacturing a wader having a thermoplastic upper and a rubber vulcanizate bottom in a water-tight and permanent bonded relationship which enables the wader industry to mass produce a low-cost, high-quality and reproducible wader product.

Other principle features and advantages of the invention will become apparent to those skilled in the art upon review of the following detailed description, claims and drawings.

DESCRIPTION OF THE DRAWING

A preferred exemplary embodiment of the present invention will hereinafter be described, wherein like designations denote like elements, and:

FIG. 1 is a side view depicting a waist wader comprised of a thermoplastic upper secured to a rubber vulcanizate bottom;

FIG. 2 is an enlarged, fragmentary crosssectional view taken along line 2—2 of FIG. 1 which shows in greater detail a particularly effective combination for bonding and securing a thermoplastic upper onto a rubber vulcanizate bottom in a water-tight relationship;

FIG. 4 is a fragmentary cross-sectional view of a lower portion of an upper taken along line 4—4 of FIG. 3 in a form suitable for assemblage and bonding onto a rubber vulcanizate bottom.

DETAILED DESCRIPTION OF A PREFERRED EXEMPLARY EMBODIMENT

Figure 3:
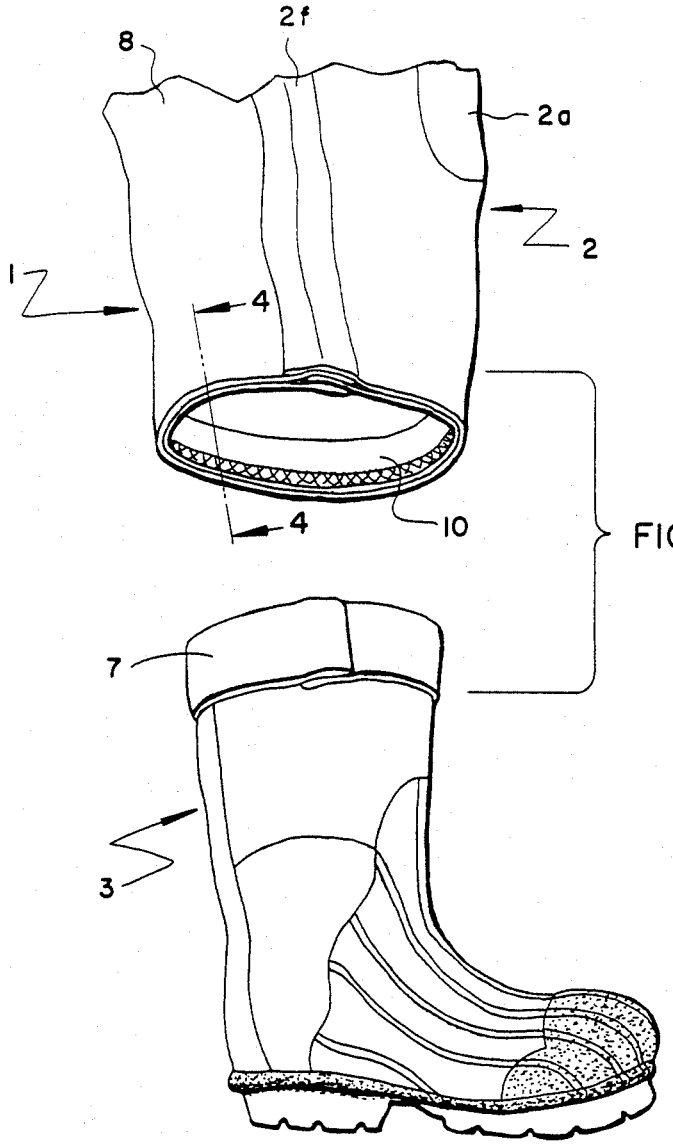
FIG. 3 is a side view showing the components, in a partially assembled form, which may be used to produce the wader product depicted in FIG. 1.

Referring to FIG. 1, a wader footwear product 1 in accordance with the present invention, comprises a thermoplastic upper assemblage 2, a rubber vulcanizate bottom 3, and a fluid tight joint 4 which securely bonds the thermoplastic upper assemblage 2 onto the rubber vulcanizate bottom 3.

The thermoplastic upper assemblage 2, as depicted in FIG. 1, also includes a knee reinforcement section 2*a*, a buttock reinforcement section 2*b*, a waist reinforcement section 2*c*, belt eyelet members 2*d* and button members 2*e* for the attachment of suspenders or shoulder straps thereto as optional accessories, and an overlapping heat-sealed seam section 2*f*.

Referring now to FIG. 2, upper assemblage 2 is formed of a thermoplastic covering member 8, and includes a lower section 9, at which joint 4 is formed to bond upper assemblage 2 to bottom 3. Fluid tight joint 4, (shown in enlarged cross-sectional view in FIG. 2) includes:

(a) a thermoplastic strip 7 circumscribing and bonded to an upper circumferential portion 6 of bottom 3; and (b) a thermoplastic band 10 circumscribing and bonded to the inner surface of lower section 9 of upper assemblage 2.

Thermoplastic strip 7 and thermoplastic band 10 are heat sealed to form the fluid-tight joint 4 between the thermoplastic upper assemblage 2 and the rubber bottom 3.

The method for manufacturing the present wader products may be more fully understood by referring to FIG. 3 which shows the component parts of wader 1 in a partially assembled form. The rubber bottom 3 may be appropriately manufactured in accordance with conventional rubber vulcanizate footwear technology. The height of the rubber vulcanizate bottom 3 may be appropriately selected so as to suit the desired wader purpose and design. For most applications, the height will normally extend above the wearer's ankle bone, e.g. normally at least 3 inches, to a height about 4 inches or more above)the wearer's knee joint. Pragmatically, bottom 3 will usually be about 10 inches or more but less than about 20 inches in height. More typically the bottom 3 height will range between 12 to 18 inches.

Rubber bottom 3 may be constructed of a variety of synthetic or natural rubber materials. Synthetic rubbers of a non-polar structure prepared from conjugated diolefin polymerizates or copolymerizates thereof possessing properties similar to natural rubbers and natural rubber are the preferred source materials for the construction of rubber vulcanizate bottoms herein.

In the manufacture of the present wader product, the circumferential portion 6 (FIG. 2) of the rubber vulcanizate bottom 3 is modified to render it compositionally compatible to an adhesive composition. If upper circumferential portion 6 of the rubber bottom 3 has not been appropriately modified, the adhesive composition, e.g. after drying or curing, will not adequately adhere and may accordingly be easily removed, e.g. by rubbing, scraping, peeling, etc. The total surface area of circumferential portion 6 must necessarily be sufficient to enable fluid tight joint 4 to firmly secure the upper assemblage 2 onto the circumferential portion of rubber bottom 3 in a water-tight relationship. A circumferential surface area commensurate with the surface area required by the thermoplastic strip 7 is generally satisfactory for this purpose.

Modification of circumferential portion 6 is suitably effected by sequence of physical and chemical techniques. Surfaces of freshly prepared rubber vulcanizates are inherently resistant towards most chemical reagents and chemical reactivity. Roughening of the vulcanizate surface such as by abrading with a wire brush, coarse emery or sand paper, e.g. 60–80 grit, will generally render the circumferential portion 6 surface area suitable for chemical treatment and alteration.

Chemical alteration of the vulcanizate structure may be effectuated by treating the vulcanizate circumferential portion 6 with a chemical reagent which chemically modifies, e.g. imparts chemical polarity to the non-polar rubber structure, the treated area so that it becomes adhesively compatible with polar adhesive compositions. Halogenating agents (often referred to as the organic and inorganic halogen donor compositions) are representative of a class of chemical reagents useful for this purpose. Acidified hypoclorite and organic halogen donor solutions, e.g. capable of releasing ionized halogens, and mixtures thereof are illustrative halogenating agents. Exemplary organic halogen donors or halogenating agents include an acidic organic solution, e.g. pH 3.5–4.5, of chloroamine, trichloroisocyanuric acid (TCI), dichloroisocyanuric acid (DCI), dichlorodimethyl hydantion (DCH), dibromodimethyl hydantoin (DBH), and triochloro-s-triazinetrion. The organic halogenating agents may be dissolved in a suitable organic solvent carrier base and directly applied by brushing, dipping, spraying, etc. onto the circumferential portion 6 under treatment conditions sufficient to chemically modify the rubber portion 6 into a halogenated rubber substrate compatible with an adhesive composition.

A variety of adhesive compositions may be utilized. In general, the adhesive composition must necessarily possess adhesive compatibility with the modified circumferented portion 6 of bottom 3, the thermoplastic strip 7 and thermoplastic band 10 which form the joint 4, while also permitting the parts thereof to be securely heat sealed to form the unitary, watertight joint 4 therebetween. The adhesive composition should appropriately possess sufficient molecular attraction and compatibility to securely bond onto the chemically modified rubber portion 6 while also possessing adequate bonding characteristics to form a unitary bond with thermoplastic strip 7. Advantageously the thermoplastic adhesive composition is applied to the portion 6 of the bottom 3 to form a layer 5 of sufficient thickness to permit the interfacing thermoplastic strip 7 to be adhesively bonded onto the portion 6 of bottom 3 to form a watertight joint.

In the preferred embodiment of the invention, a continuous and circumscribing thermoplastic adhesive coating is directly applied onto both the treated rubber vulcanizate portion 6 and the corresponding interfacing surface of thermoplastic strip 7. The interfacing adhesive composition will insure a more uniform and continuous intervening layer 5 for the bonding of strip 7 onto portion 6.

Strip 7 and band 10, as noted above, are made of a thermoplastic construction. Thermoplastics are generally recognized as polymeric materials which, when subjected to elevated temperatures, will exhibit molten or flow characteristics but will solidify upon cooling to a temperature below their respective thermoplastic melting points. Such melt characteristics are generally attributable to a relatively linear polymeric chain structure.

A broad spectrum of thermoplastic materials may be adapted to this invention. However, those thermoplastic materials generally characterized as possessing superior flexibility, heat-sealing, water-impermeability, tensile and peel bonding strengths, and shear resistance properties are considered particularly suitable components for this application. Thermoplastic polymerizates prepared from monomers of relatively high polar moieties content such as the halogenated monoethylenically unsaturated monomers, e.g. the polyvinylhalides such as polyvinylchloride, and the polyvinylidene halides such as polyvinylidene chlorides, etc.; the polyurethanes, the polyamides, the polyesters, mixtures thereof and the like may be used to especially advantage herein.

Strip 7 and band 10 may be appropriately prefabricated from calendered or flat stock to a length generally commensurate with the circumference of portion 6; when they are affixed onto the applied adhesive composition, the two ends of the strips will at least abut against one another. Overlapping one strip end onto the other end will not adversely effect the ability to form the fluid tight joint 4 since heat sealing the strip 7 and band 10 will tend to melt and bond the overlapping end onto the interfacing end of the thermoplastic strip 7 and band 10. Alternatively, the thermoplastic strips 7 and band 10 may be pre-cut from tubular material to match the diameter of the bottom 3 and upper 2. Although less desirable, the thermoplastic strip 7 and band 10 may be pre-cut so as to substantially circumscribe the outer surface of bottom 3 and the inner surface of the upper 2 leaving a gapped channel existing between the non-abutting ends which may then be filled with a thermoplastic material, e.g. a gap bridging strip and/or thermoplastic adhesive, to permit the bonding of the components together in a water-tight relationship.

The thermoplastic strip 7 may, if desired, be further reinforced by separately stitching it onto the bottom 3 or conjointly with other thermoplastic components which collectively form joint 4. A variety of natural and synthetic fibrous threads, e.g. cotton, wool, synthetic, polymeric threads, etc., may be used as stitching. Thermoplastic threads, e.g. the polyamides, polyesters, etc., are advantageously used for this purpose since they will appropriately meld together along with the other thermoplastic components to provide uniformly heat sealed segment 4 of a unitary construction.

The width and thickness of the thermoplastic strip 7 and band 10 should likewise be sufficient to permit secure bonding onto the interfacing thermoplastic components of joint 4. The width of thermoplastic strip 7 will advantageously match the width of the adhesive composition applied onto upper circumferential portion 6. In general, a width of about ½ to 1 inch of layer 5 of adhesive composition and strip 7 is suitable for most applications. Band 10 is preferably at least ½ inch in width but need not necessarily be as wide as strip 7.

The strip 7 and band 10 should likewise be of sufficient thickness to be securely heat sealed onto the interfacing components to form a water-tight relationship thereto. Relatively thin plastic of 0.010 to 0.020 inches may be used for this purpose. The maximum strip thickness is primarily predicated upon the interfacing components and the particular heat sealing conditions used to bond the thermoplastic components of joint 4 together. If the ends of the strip 7 and/or band 10 overlap, the thickness will advantageously be adjusted so as to permit the overlapping end portion to securely melt together.

Band 10 and the optional accessory components are advantageously incorporated into the design and construction of upper 2 prior to its assemblage onto bottom 3. The basic supportive structure for the upper assemblage 2 is provided by protective covering member 8. Referring to FIGS. 3 and 4, covering member 8 may be pre-cut from a suitable flat thermoplastic stock sheeting, such as currently used in the manufacture of wader products of a vinyl construction. A particularly suitable construction material for covering member 8 comprises a composite thermoplastic stock sheeting material (preferably measuring approximately 2–3 millimeters in thickness) fabricated from two polyamide, e.g. NYLON-6, woven mesh layers bound together within a polyvinyl chloride (PVC) matrix. Conventional thermal calendering or laminating techniques may be used to prepare such a composite thermoplastic stock sheeting material.

Band 10 (appropriately sized to provide an annular surface for interfacially seating onto the circumscribing thermoplastic strip 7) is suitably bonded to the interior of the lower portion 9. Referring to FIG. 4 the pre-cut band 10 is preferably initially affixed onto covering member 8 such that only the lower margin portion of band 10 is directly affixed onto covering member 8, leaving the upper margin of band 10 unattached. The band 10 may be partially secured onto the covering member 8 by heat sealing, stitching, thermoplastic adhesives or any other appropriate means. The partial securance of band 10 onto covering member 8 permits the band 10 to be more easily aligned and seated onto strip 7 while also providing a particularly effective structural component for forming fluid tight joint 4.

FIG. 3 shows a fragmentary side view of the rubber bottom 3 with the thermoplastic strip 7 affixed thereto and a prefabricated upper 2 in a form suitable for alignment with and securing to bottom 3. The thermoplastic upper assemblage 2 of FIG. 3 depicts the annular member 10 dissectionally separated from the upper 2 with the hatched drawing portion 8*a* therein revealing a fragmentary inner surface portion of covering member 8. The prefabricated thermoplastic upper 2 may be secured onto bottom 3 by aligning the annular band 10 onto the thermoplastic strip 7 and thereafter directly heat sealing the assembled thermoplastic components within the bonding area of joint 4.

Upon assemblage of upper 2 onto rubber vulcanizate bottom 3, the components forming joint 4 are heat-sealed udder sufficient pressure and heat to bond together the thermoplastic components in a watertight relationship. Under such heat sealing conditions, the pressurized interfacing surfaces of the components of joint 4 will melt and flow together. Upon subsequent cooling, the molten thermoplastic components will firmly bond together and form the desired water-tight and bonded joint 4 as illustrated in FIG. 2. The heat sealing step firmly anchors the applied thermoplastic adhesive composition onto circumferential portion 6 while also correcting for any pre-existing aberrations, non-continuous or unsealed imperfections within the bonding area and thereby uniformly bonds together the thermoplastic components of joint 4 into a heat sealed and water-tight relationship therebetween.

The band 10 is suitably heat sealed to the strip 7 by positioning a mandrel on the inside of upper 3. The mandrel suiably is of a length equal to slightly more than one-third of the circumference of the strip 7. Band 10 is aligned with the strip 7. Radio frequency or ultrasonic heat is applied to the outside of covering member 8 along band 10. This process is repeated until the band 10 is completely sealed to the strip 7 and to the interior of covering member 8.

In the preferred embodiments of the invention all of the components within joint 4 including the chemically modified vulcanizate surface area of portion 6 consist essentially of thermoplastic materials. The utilization of such thermoplastic materials permits all of the components within the critical bonding area of joint 4 to meld together and securely anchor the upper assemblage 2 onto the vulcanizate bottom 3 in a uniformly bonded and water-tight relationship.

Thermoplastic adhesives may be applied onto either of the interfacing surfaces of annular band 10 or the thermoplastic strip 7 or both to facilitate assembly and provide for a more complete union and bonding of the thermoplastic components within joint 4. If desired, stitching may be used (prior to heat sealing) to further facilitate assembly and as further reinforcement to joint 4. The stitching thereof (preferably with thermoplastic threads) may appropriately extend from the surface of exterior covering member 8 of lower section 9 through annular band 10 and strip 7 into the internal cavity of bottom 3 in a manner sufficient to securely stitch the assembled components together.

Band 10 may be relied upon for a number of purposes within the wader product and its manufacture. The band 10 facilitats proper alignment and seating of upper assemblage 2 onto bottom 3. Annular band 10 also provide a mechanism for heat sealing upper assemblage 2 onto strip 7 in a water-tight relationship while also materially contributing towards the overall bonding strength of fluid tight joint 4. Conversely, band 10 may be used predominantly as a contributing sealant component within joint 4; heat-sealing portion 9 of covering member 8 to function as a more dominant structural component in the bonding and securing of the upper assemblage 2 onto bottom 3 while band 10 would enhance the ability to heat seal the upper assemblage components onto strip 7 in a water-tight relationship.

As may be observed from FIGS. 2 and 3, the preferred embodiments of the invention contemplate the combination of strip 7 and annular band 10 as the primary components of joint 4. Although definitive manufacturing and bonding advantages are achieved by such a combination, one of the strip or band may be omitted provided adequate precautions are undertaken to insure proper alignment, heat sealing and the formation of a water-tight joint 4 between the upper 2 and bottom 3.

If the interiorly disposed annular band 10 is omitted from upper assemblage 2, other compensatory precautions must generally be undertaken to insure that upper assemblage 2 is properly seated and securely bonded onto bottom 3 in a water-tight relationship. For example, the omission of the annular band 10 which interfaces onto strip 7 may be correctively compensated by affixing the annular band 10 onto the exterior surface of member 8 within the area of lower section 9. Upon assemblage of the upper 2 onto bottom 3, the exteriorly positioned annular band 10 may then be relied upon as a supportive backing member which permits (upon pressurized heat sealing conditions) the interior surface of covering member 8 within lower section 9 to be uniformly biased against and bonded onto strip 7 in a water-tight relationship.

Alternatively, a prefabricated upper assemblage 2 fitted with the exteriorly positioned annular band 10 may be placed upon a heat sealing mandrel correspondingly sized to match the exterior circumferential shape of strip 7. Heat sealing of the irregular inner surface of the lower section 9 of member 8 directly onto the exteriorly positioned band 10 would thereby correspondingly shape the inner surface of lower section 9 for proper seating onto strip 7.

The following example is illustrative of the invention.

EXAMPLE

Rubber bottom vulcanizate 3 is prepared by initially wiping onto the uppermost circumferential portion 6, a 2% solution (weight basis) of trichloro-s-triazinetrione in ethyl acetate and allowing it to dry. The two surfaces of thermoplastic strip 7 (pre-cut from flat stock material of a lower plasticizer content) are then wiped with a cotton cloth saturated with a solvent for the purpose of removing any surface plasticizer from the strip.

A polyurethane adhesive is then applied onto the dry trichloro-s-triazinetrione treated surface 6 and the corresponding surface of strip 7. The applied adhesive coating is allowed to dry and each applied coating surface is activated by prewarming at 80 C for a few seconds.

With the activated coating on the strip 7 facing inwardly, the strip 7 is then wrapped around the vulcanizate coated area 6; with abutting overlap at the strip ends, The bond therebetween is then consolidated under pressure.

The outer surface of the strip 7 for each boot, and the internal interfacing surfaces of each of the corresponding annular bands 10 are then wiped with a solvent, allowed to dry, coated and activated with the polyurethane adhesive in the same manner as the vulcanizate strip 7 above and the band 10 and strip 7 matingly brought together under pressure to adhesively consolidate the bond therebetween.

The respective mated annular band 10 and strip for each legging and boot are then heat sealed together under a pressure of 100 to 150 pounds per square inch and a temperature of 200° to 275° F. to bond the protective covering member 8, annular band 10, strip 7 and applied polyurethane adhesive layer 5 together onto the chemically modified portion of the bottom 3.

The bond strength of the adhesive band between bottom 3 and thermoplastic strip is preferably greater than 6 pounds. Tests were made on a one inch wide strip at a rate of pull of 20 inches/minute. The bond strength was found to be greater than the cohesive strength of the rubber which failed at ten pounds.

Illustrative thermoplastic adhesive compositions which may be used herein include those possessing heat-sealing attributes while also exhibiting adhesive and heat sealing compatibility with component parts within the bonding area which interface onto the adhesive composition. Normally the heat sealing is conducted at a temperature sufficient to penetrate into the bonding area and allow the abutting component surfaces to melt together. Upon cooling a unitary fluid tight joint will be formed therebetween.

It is to be understood that the invention is not limited in its application to the details of construction nor the arrangement of components set forth in the aforegoing description or illustrated in the drawings. The phraseology and terminology used herein is for the purpose of description and should not be regarded as limiting. The invention is capable of other embodiments and of being practiced or being carried out in various ways. Modifications may be made in the form and arrangement of the elements without departing from the scope of the invention, as set forth in the following claims.

We claim:

1. A method for the manufacture of a thermoplastic rubber wader footwear product comprised of a rubber vulcanizate bottom, at least one circumscribing thermoplastic strip and a thermoplastic upper, the bottom, strip and upper being securely bonded in a water-tight relationship, said method comprising:

(a) treating an upper outer circumferential area of a rubber vulcanizate bottom with a chemical reagent so as to render said treated area compatible with an adhesive composition;

(b) applying an adhesive composition onto said treated area;

(c) adhesively bonding a circumscribing thermoplastic strip onto said adhesive composition;

(d) placing a thermoplastic upper having a lower portion sized so as to circumferentially seat onto said thermoplastic strip, and;

(e) applying sufficient pressure and heat to the lower portion of said upper to bond said applied adhesive composition, said thermoplastic strip and said lower portion together to provide a wader product wherein said thermoplastic upper is securely bonded onto said rubber vulcanizate bottom in a water-tight relationship.

2. The method according to claim 1 including the step of securing a thermoplastic band to the lower portion of the thermoplastic upper so as to provide an annular interfacing seating surface for bonding said upper to said strip.

3. The method according to claim 2 wherein the applied adhesive composition consists essentially of a thermoplastic adhesive composition.

4. The method according to claim 3 wherein said reagent is a halogenating agent.

5. The method according to claim 3 wherein said thermoplastic upper, said thermoplastic strip and said thermoplastic band are comprised of polyvinylchloride.

6. A method for the manufacture of a thermoplastic rubber footwear product comprised of a rubber bottom and a thermoplastic upper securely bonded onto said rubber bottom in a fluid-tight relationship therebetween, said method comprising:

(a) treating an upper circumferential portion of a rubber bottom with a chemical agent to render the treated portion compatible with a thermoplastic adhesive;

(b) applying onto the treated portion a thermoplastic adhesive composition;

(c) adhesively bonding a circumscribing thermoplastic strip onto the applied adhesive composition;

(d) aligning onto said thermoplastic strip a thermoplastic upper, the lower portion of which contains a thermoplastic band sized so as to provide an interfacing annular seating surface onto said circumscribing thermoplastic strip, and (e) heat sealing together with said interfacing annular band, the applied adhesive composition and the bonded thermoplastic strip to provide a fluid-tight, unitary bond therebetween.

7. The method according to claim 6 including the step of abrading the circumferential portion of the rubber bottom prior to the treating step.

8. The method of claim 6 or 7 wherein said chemical agent is a halogenating agent.

9. A thermoplastic rubber footwear wader product having a thermoplastic upper securely bonded onto a rubber vulcanizate bottom in a fluid-tight relationship, said product comprising:

(a) a rubber vulcanizate bottom, (b) a layer of thermoplastic adhesive applied to an upper circumferential portion of said bottom;

(c) a thermoplastic strip circumscribing said layer and adhesively bonded to said bottom;

(d) a thermoplastic upper having an upwardly extending section and a lower section; and (e) an annular band interfacially circumscribing and bonded to said thermoplastic upper;

(f) said thermoplastic strip being heat sealed to said annular band to form a fluid-tight seal which securely bonds said thermoplastic upper onto said rubber bottom.

10. A thermoplastic-rubber footwear product comprised of a rubber vulcanizate bottom having an upper circumferential portion, an upper peripheral margin of said portion being chemically treated so as to form a bonding area compatible with an adhesive composition, a thermoplastic strip sized so as to circumscribe the upper circumferential portion of said bottom, an adhesive composition bonding said strip to said upper portion of said bottom to form a heat sealing bonding area, a thermoplastic upper equipped with a lower section sized so as to circumscribe the upper circumferential portion of said bottom, said lower section of said upper being securely bonded onto said strip whereby the lower portion of said upper is securely bonded to said circumferential portion of said bottom in a fluid-tight relationship therebetween.

11. The product according to claim 10 wherein said thermoplastic strip is circumferentially seated and heat sealed onto said adhesive composition in a water-tight relationship.

12. The product according to claim 11 wherein the lower section of said thermoplastic upper includes a thermoplastic annular band sized to circumferentially seat onto said thermoplastic strip said annular band and said thermoplastic strip forming a heat sealed bond between said lower section of said upper and said upper portion of said bottom in a fluid-tight relationship.

* * * * *